US009287100B2

(12) United States Patent
Szalay et al.

(10) Patent No.: US 9,287,100 B2
(45) Date of Patent: Mar. 15, 2016

(54) COLLISION ION GENERATOR AND SEPARATOR

(71) Applicant: MICROMASS UK LIMITED, Wilmslow (GB)

(72) Inventors: Daniel Szalay, Budapest (HU); Lajos Godorhazy, Erd (HU); Zoltan Takats, Budapest (HU)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 14/368,797

(22) PCT Filed: Dec. 28, 2012

(86) PCT No.: PCT/IB2012/002995

§ 371 (c)(1),
(2) Date: Jun. 25, 2014

(87) PCT Pub. No.: WO2013/098642

PCT Pub. Date: Jul. 4, 2013

(65) Prior Publication Data

US 2014/0353489 A1 Dec. 4, 2014

Related U.S. Application Data

(60) Provisional application No. 61/580,715, filed on Dec. 28, 2011.

(51) Int. Cl.
*H01J 49/00* (2006.01)
*H01J 49/04* (2006.01)
(Continued)

(52) U.S. Cl.
CPC ..... *H01J 49/0031* (2013.01); *H01J 49/0445* (2013.01); *H01J 49/0454* (2013.01); *H01J 49/14* (2013.01); *H01J 49/16* (2013.01)

(58) Field of Classification Search
USPC ..... 250/281, 282, 288, 423 R, 424, 425
See application file for complete search history.

(56) References Cited

U.S. PATENT DOCUMENTS 3,479,545 A 11/1969 Wilson et al.
4,935,624 A 6/1990 Henion et al.
(Continued)

FOREIGN PATENT DOCUMENTS

EP 1855306 A1 11/2007
JP 2004-264043 9/2004
(Continued)

OTHER PUBLICATIONS

PCT International Search Report mailed Sep. 10, 2013 in PCT App. No. PCT/IB2012/002995 in 3 pages.
(Continued)

*Primary Examiner* — Nicole Ippolito
*Assistant Examiner* — Hanway Chang
(74) *Attorney, Agent, or Firm* — Knobbe, Martens, Olson & Bear, LLP

(57) ABSTRACT

According to some embodiments, systems and methods for surface impact ionization of liquid phase and aerosol samples are provided. The method includes accelerating a liquid or aerosol sample, colliding the sample with a solid collision surface thereby disintegrating the sample into both molecular ionic species (e.g., gaseous molecular ions) and molecular neutral species (e.g., gaseous sample), and transporting the disintegrated sample to an ion analyzer. Some embodiments of the method further comprise discarding the molecular neutral species. Such embodiments transport substantially only the molecular ionic species to the ion analyzer.

38 Claims, 11 Drawing Sheets

(51) Int. Cl.

| | |
|---|---|
| ***H01J 49/16*** | (2006.01) |
| ***H01J 49/14*** | (2006.01) |

(56) References Cited

U.S. PATENT DOCUMENTS

| | | | |
|---|---|---|---|
| 5,559,326 | A | 9/1996 | Goodley et al. |
| 5,869,344 | A | 2/1999 | Linforth et al. |
| 6,531,318 | B1 | 3/2003 | Palmer-Toy et al. |
| 6,825,464 | B2 | 11/2004 | De La Mora |
| 6,838,663 | B2 | 1/2005 | Coon et al. |
| 7,161,144 | B2 | 1/2007 | Syage et al. |
| 7,335,897 | B2 | 2/2008 | Takats et al. |
| 7,564,028 | B2 | 7/2009 | Vestal |
| 7,687,772 | B2 | 3/2010 | Shiea |
| 7,928,364 | B2 | 4/2011 | Musselman |
| 8,203,117 | B2 | 6/2012 | Wiseman et al. |
| 8,286,260 | B2 | 10/2012 | Vertes et al. |
| 8,314,382 | B2 | 11/2012 | Takats |
| 8,324,570 | B2 | 12/2012 | Wiseman et al. |
| 8,395,116 | B2 | 3/2013 | Harada et al. |
| 9,046,448 | B2 | 6/2015 | Takats |
| 2002/0008871 | A1 | 1/2002 | Poustka |
| 2002/0070338 | A1 | 6/2002 | Loboda |
| 2002/0076824 | A1 | 6/2002 | Haglund, Jr. et al. |
| 2003/0008404 | A1 | 1/2003 | Tomita et al. |
| 2003/0119193 | A1 | 6/2003 | Hess et al. |
| 2003/0193023 | A1 | 10/2003 | Marsh |
| 2004/0007673 | A1 | 1/2004 | Coon et al. |
| 2004/0124352 | A1 | 7/2004 | Kashima et al. |
| 2004/0235395 | A1 | 11/2004 | Hashish et al. |
| 2005/0017091 | A1 | 1/2005 | Olsen et al. |
| 2005/0032471 | A1 | 2/2005 | Pfarr et al. |
| 2005/0072916 | A1 | 4/2005 | Park |
| 2005/0074361 | A1 | 4/2005 | Tanoshima et al. |
| 2005/0077644 | A1 | 4/2005 | Bryan et al. |
| 2005/0138861 | A1 | 6/2005 | O'Connor |
| 2005/0154490 | A1 | 7/2005 | Blaine et al. |
| 2005/0159765 | A1 | 7/2005 | Moutafis et al. |
| 2005/0178962 | A1 | 8/2005 | Guevremont et al. |
| 2005/0230635 | A1 | 10/2005 | Takats et al. |
| 2005/0258358 | A1 | 11/2005 | Thakur |
| 2006/0035570 | A1 | 2/2006 | Chisum et al. |
| 2006/0091308 | A1 | 5/2006 | Boyle et al. |
| 2006/0097084 | A1 | 5/2006 | Gromer et al. |
| 2006/0108539 | A1 | 5/2006 | Franzen |
| 2006/0186334 | A1 | 8/2006 | Jolliffe et al. |
| 2006/0250138 | A1 | 11/2006 | Sparkman et al. |
| 2006/0255264 | A1 | 11/2006 | Belford |
| 2007/0023631 | A1 | 2/2007 | Takats |
| 2007/0023677 | A1 | 2/2007 | Perkins et al. |
| 2007/0094389 | A1 | 4/2007 | Nussey et al. |
| 2007/0110666 | A1 | 5/2007 | Pevsner et al. |
| 2007/0114437 | A1 | 5/2007 | Kovtoun |
| 2007/0176113 | A1 | 8/2007 | Shiea |
| 2008/0001081 | A1 | 1/2008 | Jindai et al. |
| 2008/0067352 | A1 | 3/2008 | Wang |
| 2008/0149822 | A1 | 6/2008 | Vertes et al. |
| 2008/0172075 | A1 | 7/2008 | Ammann |
| 2008/0173809 | A1 | 7/2008 | Wu |
| 2008/0234579 | A1 | 9/2008 | Halevy-Politch et al. |
| 2008/0262321 | A1 | 10/2008 | Erad et al. |
| 2009/0065714 | A1 | 3/2009 | Keady |
| 2010/0078550 | A1 | 4/2010 | Wiseman et al. |
| 2010/0096546 | A1 | 4/2010 | Ewing et al. |
| 2010/0280409 | A1 | 11/2010 | Mark |
| 2011/0152759 | A1 | 6/2011 | Clymer et al. |
| 2011/0215233 | A1 | 9/2011 | Vertes et al. |
| 2012/0112057 | A1 | 5/2012 | Musselman |
| 2012/0156712 | A1 | 6/2012 | Takats |
| 2013/0082172 | A1 | 4/2013 | Syage et al. |

FOREIGN PATENT DOCUMENTS

| | | |
|---|---|---|
| JP | 2005-527786 | 9/2005 |
| JP | 2005-539199 | 12/2005 |
| JP | 2007-513695 | 5/2007 |
| JP | 2007-170870 | 7/2007 |
| JP | 2008-147165 | 6/2008 |
| JP | 2009-539093 | 11/2009 |
| JP | 2009-539114 | 11/2009 |
| JP | 2012-505519 | 3/2012 |
| WO | WO 85/04093 | 9/1985 |
| WO | WO 2005/094389 | 10/2005 |
| WO | WO 2006/081240 | 8/2006 |
| WO | WO 2007/138371 | 12/2007 |
| WO | WO 2007/140351 | 12/2007 |
| WO | WO 2009/157312 | 12/2009 |
| WO | WO 2012/061143 | 5/2012 |
| WO | WO 2012/164312 | 12/2012 |

OTHER PUBLICATIONS

Al Sahaf, O. S., et al. "Chemical composition of smoke produced by high-frequency electrosurgery." Irish journal of medical science 176.3 (2007): 229-232.

Barrett, William L., and Shawn M. Garber. "Surgical smoke: a review of the literature." Surgical endoscopy 17.6 (2003): 979-987.

Down, S., "A DESI-rable ionization revolutionizes mass spectrometry", Base Peak, Aug. 15, 2005.

Lee et al., "Thermally Assisted Electrospray Interface for Liquid Chromatography/Mass Spectrometry," Rapid Commun. Mass Spectrom. 1992, 6:727-733.

Liang Qiao et al., "Electrostatic-Spray Ionization Mass Spectrometry," Analytical Chemistry, vol. 84, No. 17, Sep. 4, 2012, pp. 7422-7430.

McEwen et al., "Analysis of Solids, Liquids, and Biological Tissues Using Solids Probe Introduction at Atmospheric Pressure on Commercial LC/MS Instruments," Anal. Chem. 2005, 77:7826-7831.

Moot, et al. "Composition of Volatile Organic Compounds in Diathermy Plume as Detected by Selected Ion Flow Tube Mass Spectrometry," ANZ Journal of Surgery, 2007, vol. 77, pp. 20-23 in 4 pages.

International Search Report and Writen Opinion for International Appln No. PCT/IB2012/003009, dated Aug. 14, 2013, 6 pages.

PCT International Search Report for International Appln No. PCT/IB2010/001261, dated Sep. 30, 2010, 5 pages.

Sakairi et al., "Characteristics of a Liquid Chromatograph/Atmospheric Pressure Ionization Mass Spectrometer," Anal. Chem. 1988, 60:774-780.

Takats et al., "Characterization of DESI-FTICR mass spectrometry—from ECD to accurate mass tissue analysis," J. Mass Spectrom. 2008, 43:196-203, published online Oct. 8, 2007.

Takats, Z. et al., "Mass spectrometry Sampling under Ambient Conditions with Desorption Electrospray Ionization", Science, Oct. 15, 2004, vol. 306.

Tottszer et al., "Laser heating versus resistive heating in the field-desorption mass spectrometry of organic polymers," J. Phys. D: Appl. Phys. 1988, 21:1713-1720.

Written Opinion of the International Searching Authority, for International Application No. PCT/IB2012/002995, date of mailing: Sep. 10, 2013 (6 pages).

COLLISION ION GENERATOR AND SEPARATOR

BACKGROUND OF THE INVENTION

1. Field

The present invention relates to devices, systems and methods for quantifying, analyzing and/or identifying chemical species. More specifically, the present invention relates to devices, systems and methods for the conversion of certain molecular components of aerosols and liquid phase samples to gaseous molecular ions through a surface impact phenomenon which disintegrates aerosol particles or liquid jets into smaller particles including gas-phase molecular ions.

2. Description of the Related Art

Mass spectrometry is generally used for the investigation of the molecular composition of samples of arbitrary nature. In traditional mass spectrometric analysis procedures, the molecular constituents of samples are transferred to their gaseous phase and the individual molecules are electrically charged to yield gas-phase ions which can then be subjected to mass analysis, such as separation and selective detection of the ions based on their different mass-to-charge ratios.

Since certain molecular constituents are non-volatile, the evaporation of these compounds is not feasible prior to electrical charging. Traditionally, chemical derivatization was used to enhance the volatility of such species by eliminating polar functional groups. However, chemical derivatization also fails in case of larger molecules, representatively including oligosaccharides, peptides, proteins, and nucleic acids. In order to ionize and mass spectrometrically investigate these species of biological relevance, additional ionization strategies have been developed, including desorption and spray ionization.

In desorption ionization (excepting field desorption), condensed phase samples are bombarded with a beam of high energy particles, known as an analytical beam, to convert the condensed phase molecular constituents of samples into gaseous ions in a single step. The low sensitivity of this technique combined with its incompatibility with chromatographic separation hinders its general applicability to the quantitative determination of biomolecules in biological matrices. The poor sensitivity from which desorption ionization methods suffer is generally associated with the fact that most of the material is desorbed in the form of large molecular clusters with low or no electric charging. Recently, a number of methodological approaches have been described for converting these clusters into gaseous ions using a process termed secondary ionization or post-ionization. These methods employ a second ion source producing a high current of charged particles which efficiently ionizes the aerosol formed on the desorption ionization process.

Spray ionization methods were developed as an alternative to desorption ionization techniques and were intended to address the same problems addressed by desorption ionization—the ionization of non-volatile constituents of arbitrary samples. In spray ionization, liquid phase samples are sprayed using electrostatic and/or pneumatic forces. The resulting electrically charged droplets produced by the spraying are gradually converted to individual gas-phase ions upon the complete evaporation of the solvent. Spray ionization methods, particularly electrospray ionization, show superior sensitivity when compared to the desorption ionization methods mentioned above as well as excellent interfacing capabilities with chromatographic techniques (something for which desorption ionization was unsuccessful).

While theoretically spray ionization methods are able to provide nearly 100% ionization efficiency, such a high value is generally not reached because of practical implementation issues. Nanoelectrospray, or nanospray, methods give very high ionization efficiency but are limited to extremely low flow rates; such methods can only give high ionization efficiency for flow rates in the low nanoliter per minute range. Since practical liquid chromatographic separations involve higher liquid flow rates (e.g., including high microliters per minute to low milliliters per minute), nanospray is not the usual method of choice for liquid chromatographic-mass spectrometric systems. Pneumatically assisted electrospray sources are theoretically capable of spraying liquid flow in such ranges; however their ionization efficiency falls precipitously to the 1-5% range. Similarly to desorption ionization methods, spray ionization sources also produce considerable amounts of charged and neutral clusters which decreases ionization efficiency and can tend to contaminate mass spectrometric atmospheric interfaces.

The atmospheric interface of a mass spectrometer is designed to introduce ions formed by spray or atmospheric pressure desorption ionization to the vacuum regime of the mass spectrometer. The basic function of the atmospheric interface is to maximize the concentration of ions entering the mass spectrometer while reducing the amount or concentration of neutral molecules entering the mass spectrometer (e.g., air, solvent vapors, nebulae seen gases, etc.). The currently used approach in commercial instruments is to introduce the atmospheric gas into the mass spectrometer vacuum chamber and sample the core of the free supersonic vacuum jet using a skimmer electrode. Such an approach is based on the assumption that the ions of interest have a lower radial velocity component and will therefore be concentrated in the central core of the gas jet. The skimmer electrode is generally followed by radio-frequency alternating potential driven multi-pole ion guides which transmit the ionic species to the mass analyzer while the neutrals are statistically scattered and pumped out by the vacuum system. Such a combination of skimmer electrode and radio-frequency alternating potential driven multi-pole ion guides can allow up to 30% ion transmission efficiency; however, it does not solve or manage the problem of contamination by larger molecular clusters.

Further developments to mass spectrometers included the addition of a circular electrode around the rim of the skimmer electrode used to deflect more charged species into the opening of the skimmer electrode. The ring electrode, or "tube lens" as it is sometimes called, also allows the shift of the skimmer electrode sideways from the co-axial position relative to the first conductance limit. The offset can be partially compensated by applying electrostatic potential to the tube lens. Positioning the skimmer electrode in such a manner stops neutrals of arbitrary size (including clusters) from entering into the high vacuum regime of the mass spectrometer.

Another atmospheric interface configuration includes the introduction of ion-carrying atmosphere directly into a ring electrode ion guide. Bipolar radiofrequency alternating current is applied to a stack of ring electrodes thereby creating a longitudinal pseudo-potential valley for charged species, while neutrals are able to leave the lens stack by passing in between the individual electrodes. An electrostatic potential ramp (or a traveling wave) can be used to actively accelerate ions towards the mass spectrometric analyzer. Such devices, generally known as "ion funnels" can give close to 100% ion transmission efficiency in ion current ranges three to four orders of magnitude wide. Ion funnels have been modified in various ways to minimize the influx of neutrals and molecular clusters into the ion optics and mass analyzer. The simplest such solution includes the mounting of a jet-disrupter in the central axis of the funnel to block the trajectory of neutrals and molecular clusters flying through the ion funnel. Alternate solutions include: an asymmetric funnel geometry in which the exit orifice of the funnel is in an off-axis position relative to the atmospheric inlet; and twin-funnels in which the ion-carrying atmospheric gas is introduced into one funnel and the ions extracted sideways into a contralateral funnel, which is later connected to the ion optics of the instrument, using an electrostatic field(s).

However, there is a need for improved systems and methods for the conversion of liquid samples into gaseous ions.

SUMMARY

In some embodiments, a method for generating gaseous molecular ions for analysis by a mass spectrometer or ion mobility spectrometer includes accelerating a sample toward a solid surface, colliding the sample with the solid surface, and collecting the resulting gaseous molecular ions and directing them to an analyzer unit. The sample includes one of an aerosol sample and a liquid sample which further includes one or more of molecular particle clusters, solid particles and charged particles. The collision is intended to disintegrate the one or more molecular particle clusters, thereby forming one or more gaseous molecular ions, neutral molecules, and smaller-sized molecular particle clusters.

In some embodiments, a system for generating gaseous molecular ions for analysis by a mass spectrometer or ion mobility spectrometer includes a tubular conduit, a collision element, and a skimmer electrode. The tubular conduit is configured to accelerate a sample therethrough. The sample accelerated within the system includes one of an aerosol sample and a liquid sample and has one or more of molecular particle clusters, solid particles and charged particles. The collision element is spaced apart from an opening of the tubular conduit and is generally aligned with an axis of the tubular conduit. The collision element has a surface upon which the sample collides, disintegrating the one or more molecular particle clusters to form one or more of gaseous molecular ions, neutral molecules and smaller-sized molecular particle clusters. The skimmer electrode is configured to collect the gaseous molecular ions. The skimmer electrode has an opening generally aligned with the tubular conduit opening, such that the collision element is interposed between the tubular conduit opening and the skimmer electrode.

In some embodiments, a system for generating gaseous molecular ions for analysis by a mass spectrometer or ion mobility spectrometer includes a tubular conduit, a collision element, and an ion funnel guide assembly. The tubular conduit is configured to accelerate a sample therethrough. The sample accelerated through tubular conduit includes one of an aerosol sample and a liquid sample and has one or more of molecular particle clusters, solid particles and charged particles. The collision element is spaced apart from an opening of the tubular conduit and is generally aligned with an axis of the tubular conduit. The collision element has a generally spherical surface on which the sample collides. The collision between the sample and the generally spherical collision element disintegrates the one or more molecular particle clusters to form one or more gaseous molecular ions, neutral molecules and smaller-sized molecular particle clusters. The ion funnel guide assembly is generally aligned with the tubular conduit opening and is driven by a bipolar radiofrequency alternating current. The collision element is disposed in the ion funnel. The ion funnel guide assembly is configured to separate the gaseous molecular ions from the neutral molecules and smaller sized molecular particle clusters, and to direct the gaseous molecular ions to an analyzer.

In some embodiments, a system for generating gaseous molecular ions for analysis by a mass spectrometer and/or ion mobility spectrometer includes a tubular conduit, a skimmer electrode, and an analyzer unit. The tubular conduit is configured to accelerate a sample therethrough. The sample accelerated through the tubular conduit includes one of an aerosol sample and a liquid sample and has one or more of molecular particle clusters, solid particles and charged particles. The skimmer electrode is spaced apart from and generally aligned with an opening of the tubular conduit. The skimmer electrode has a tubular section with a surface upon which the sample particles collide to generate gaseous molecular ions. The analyzer unit which receives the gaseous molecular ions from the skimmer electrode is configured to analyze the gaseous molecular ions to provide information on the chemical composition of the sample.

DETAILED DESCRIPTION

Figure 1:
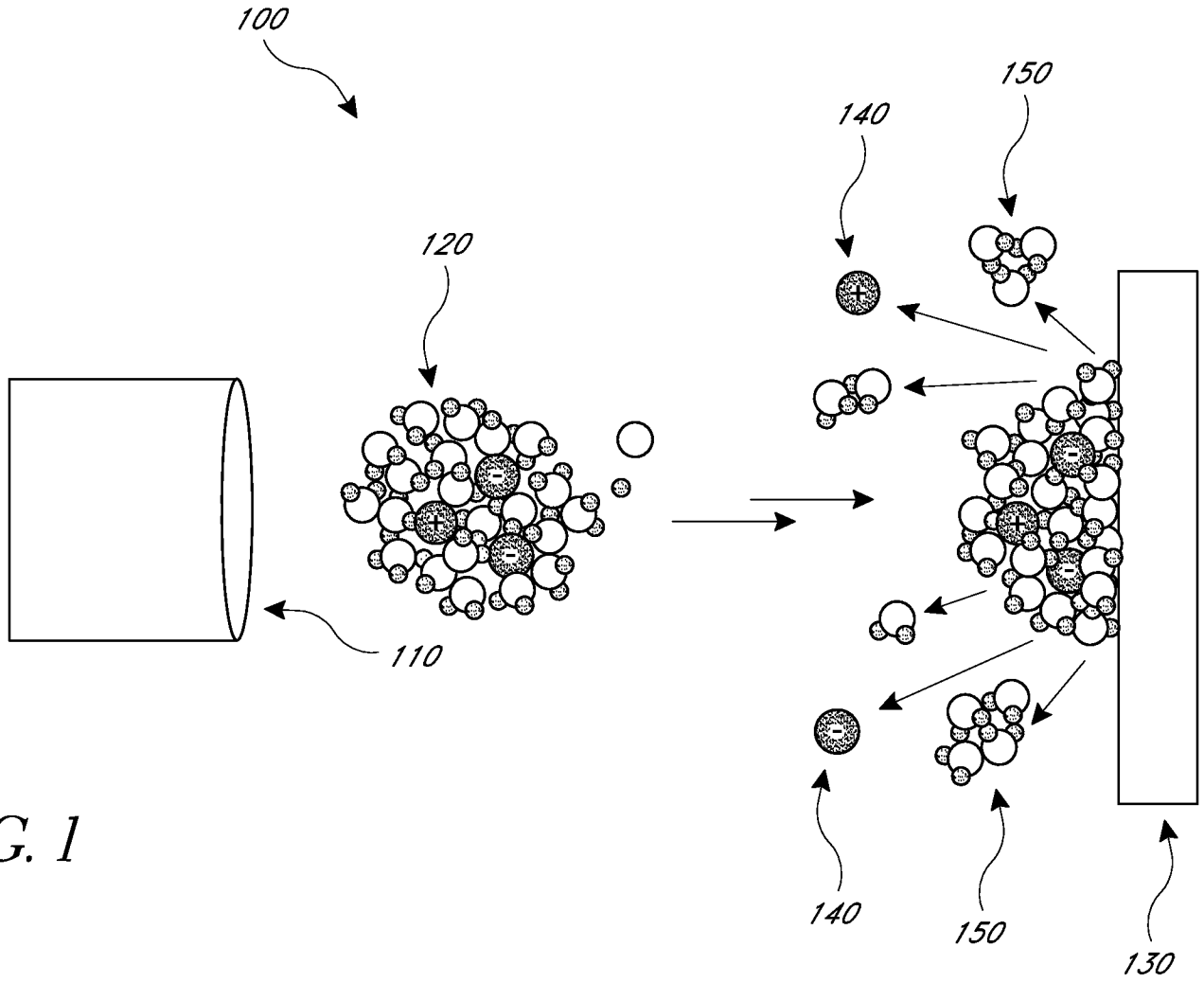
FIG. 1 is a schematic view of one embodiment of a system for surface impact ionization.

FIG. 1 illustrates one embodiment of a system for surface impact ionization 100. The system 100 includes a sample inlet 110, a sample 120 (e.g., a sample beam), a collision surface 130, at least one ionic species formed on the impact event 140 and other molecular neutral species 150.

In operation, the sample 120, comprised of one or more molecular clusters, solid particles, neutral particles and charged particles (e.g., in the form of an aerosol or liquid), is introduced through the sample inlet 110 from a high pressure regime to the lower pressure regime of a mass spectrometer device. Particles of the sample 120 are accelerated by the pressure differential of the high pressure regime to low pressure regime. After acceleration, the heterogeneous or homogenous accelerated sample 120 impacts onto the collision surface 130 (e.g., a solid surface), which disintegrates the molecular clusters or continuous liquid jet of the sample 120 (see FIG. 3) into gaseous molecular species, including individual molecular neutral species 150, and molecular ionic species 140 (e.g., gaseous molecular ions). The impact driven disintegration is purely mechanical, driven by the kinetic energy of the particles in the sample 120 and produces both positive and negative ions. Both the positive and negative ionic species formed on the impact event between the sample 120 and collision surface 130 are collected and transferred into the ion optics of the ion analyzer unit (see FIG. 1B). In some embodiments, the systems and methods disclosed herein can result in improved signal to noise ratios of greater than 1%, greater than 10%, greater than 50%, greater than 100%, and greater than 200%, as well as values in between.

In one embodiment, (shown in FIG. 1B) the system 100 can be part of a larger ion analysis system 185 that includes a sample source 190 that provides, directs or guides samples to the system 100, (which operates as discussed with respect to FIG. 1), and an ion analyzer 195 disposed downstream of the system 100, which receives the gaseous molecular ions from the system 100 and analyzes them to provide information on the sample's chemical constituents.

In some embodiments, the sample inlet 110 is a tubular opening at the end of a tubular conduit. The tubular conduit can have a round cross-section. In other embodiments, the tubular conduit can have other suitable cross-sections.

In some embodiments, the high pressure regime from which the sample inlet 110 introduces the sample 120 is at atmospheric pressure. In other embodiments, the high pressure regime from which the sample inlet 110 introduces the sample 120 is at a pressure higher than atmospheric pressure. In another embodiment, the high pressure regime from which the sample inlet 110 introduces the sample 120 is below atmospheric pressure (e.g., being high relative to the internal pressure of the ion analyzer device).

In some embodiments, the acceleration provided by the pressure differential of the high pressure regime to low pressure regime is augmented by the addition of a power source which can establish an electrical potential gradient between the sample inlet 110 and the collision surface 130 (e.g., collision element). Establishing such a potential gradient can cause or increase the acceleration of the charged particles included in the sample 120.

In some embodiments, the mechanical force based disintegration of the sample 120 and generation of molecular ionic species 140 (e.g., gaseous molecular ions) can be augmented, or further facilitated, by elevating the temperature of the collision surface 130. In some embodiments, the temperature of the collision surface 130 can be elevated via contact heating, resistive heating, or radiative heating of the collision surface 130. In some embodiments, the collision surface 130 can kept at subambient temperatures. In other embodiments, the collision surface 130 can be kept at ambient or superambient temperatures (e.g., up to 1000° C. or higher). In some embodiments, the sample inlet 110 can be kept at subambient temperatures. In other embodiments, the sample inlet 110 can be kept at ambient or superambient temperature (e.g., up to 1000° C. or higher). In some embodiments, a temperature difference is applied between the collision surface 130 and the other elements of the system for surface impact ionization 100 (e.g., sample inlet 110, or other surfaces). In some of these embodiments in which a temperature difference is applied, the collision surface 130 is at a higher temperature than the other elements of the system for surface impact ionization 100 (e.g., sample inlet 110 or other surfaces). In other embodiments in which a temperature difference is applied, the collision surface 130 is at a lower temperature than the other elements of the system for surface impact ionization 100.

Figure 1B:
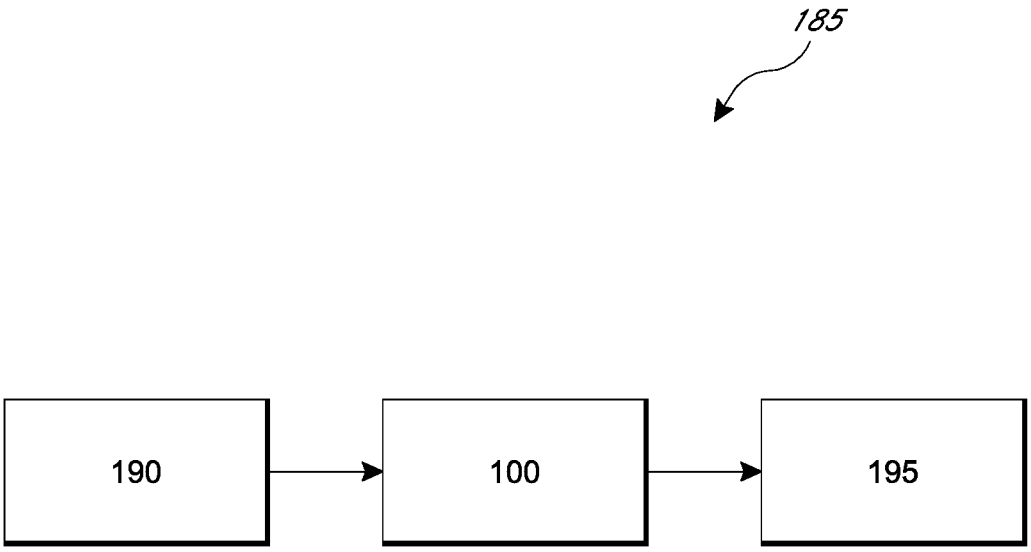
FIG. 1B is a block diagram of one embodiment of a system for converting a liquid phase sample into gaseous ions and for analyzing the gaseous ions.

In some embodiments, the ratio of positive and negative ions produced upon impact is shifted by applying a potential difference between the collision surface 130 and the ion optics of the mass spectrometer (such as the ion analyzer 195 in FIG. 1B). Applying a positive electrical potential on the collision surface 130 relative to the first element of the ion optics can enhance the formation of positive ions and suppress the formation of negative ions. As a corollary, applying a negative electrical potential on the collision surface 130 relative to the first element of the ion optics can enhance the formation of negative ions and suppress the formation of positive ions. Therefore, in these embodiments, when the ion of interest is a negatively charged species, it is useful to apply a negative potential between the collision surface 130 relative to the ion optics. Conversely, when the ion of interest is a positively charged species, it is useful to apply a positive potential between the collision surface 130 and the ion optics. Additionally, the application of electrostatic potential between the collision surface 130 and the ion optics can advantageously minimize the neutralization of already-existing ionic components of the sample 120.

In some embodiments, the collision surface 130 is placed in an ion funnel or ring electrode type ion guide, as disclosed below, which can advantageously increase collection and transmission efficiency of both the originally introduced ions and those formed on the impact event to substantially 100%. In one embodiment, the collision surface 130 is substantially flat (e.g., as is depicted in FIG. 1). In other embodiments the collision surface 130 can have other shapes (e.g., curved, spherical, teardrop, concave, dish-shaped, conical, etc.) In some embodiments, the at least one ionic species formed on the impact event 140 (e.g., gaseous molecular ions) can be directed to a skimmer electrode, such as the skimmer electrodes disclosed herein, after colliding with the collision surface 130.

FIG. 1B illustrates a block diagram of a system for converting a liquid sample into gaseous ions and analyzing the gaseous ions 185. The system 185 includes a sample source 190, the surface impact ionization system 100 of FIG. 1, and an ion analyzer 195.

In some embodiments, the sample source 190 provides, directs or guides samples to the system 100, (which operates as discussed with respect to FIG. 1).

In some embodiments, the ion analyzer 195, disposed downstream of the system 100, receives the gaseous molecular ions from the system 100 and analyzes them to provide information on the sample's chemical constituents. In some embodiments, the ion analyzer 195 is a mass spectrometer. In other embodiments, the ion analyzer 195 is an ion mobility spectrometer. In yet other embodiments, the ion analyzer 195 is a combination of both a mass spectrometer and an ion mobility spectrometer.

Figure 2:
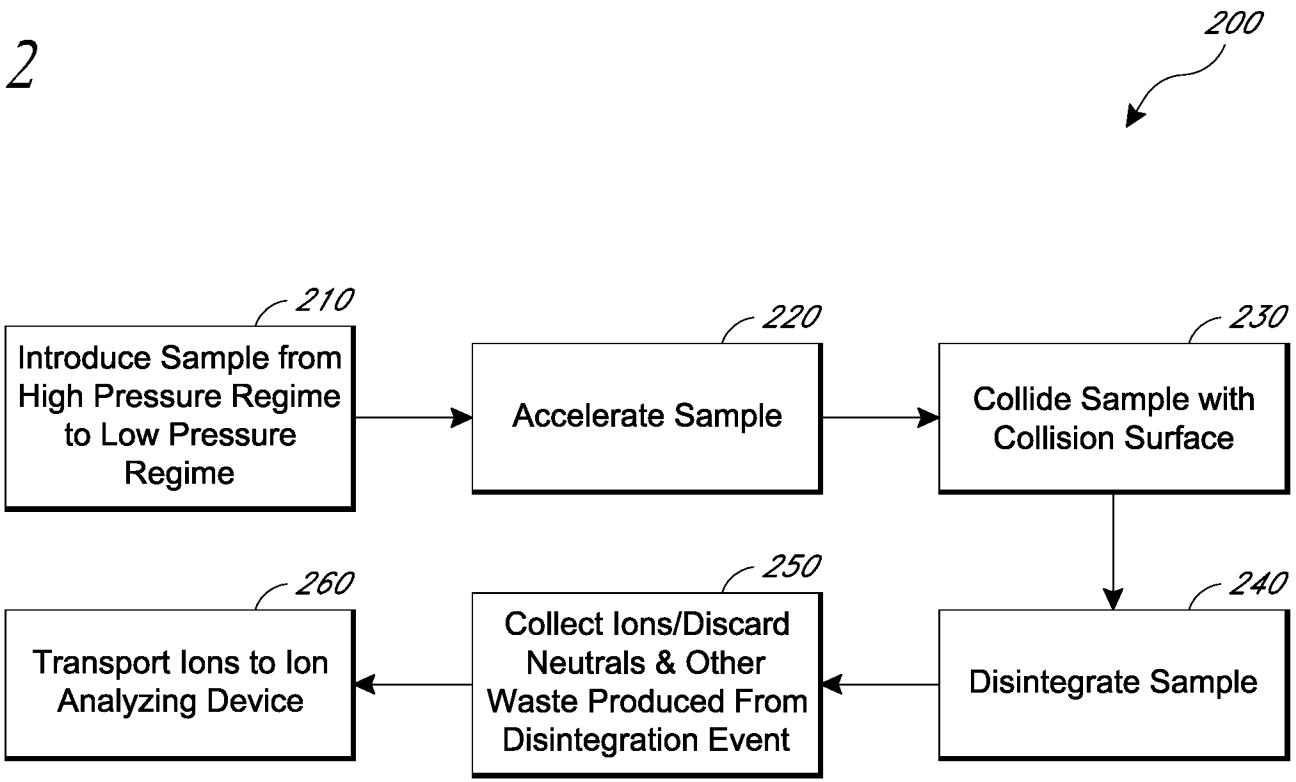
FIG. 2 is a flow chart of one embodiment of a method for converting a liquid phase sample into gaseous ions and for analyzing the gaseous ions.

FIG. 2 illustrates a flow chart of one embodiment of a method for preparing a sample for mass spectroscopic analysis 200.

First, at step 210, a sample 120 of FIG. 1 is introduced from the high pressure regime of the sample inlet 110 of FIG. 1 into the low pressure regime (e.g., vacuum) of the mass spectrometer.

In some embodiments, the sample is an aerosol sample. In other embodiments, the sample is a liquid sample.

Next, at step 220, the sample 120 of FIG. 1 is accelerated. In some embodiments, the acceleration is effected only by the passage of the sample 120 of FIG. 1 from the high pressure regime of the sample inlet 110 of FIG. 1 to the low pressure regime of the mass spectrometer. In some embodiments, the acceleration is augmented or caused by the application of an electrical potential gradient between the sample inlet 110 of FIG. 1 and the collision surface 130 of FIG. 1 to cause an acceleration of the charged particles contained in the sample 120 of FIG. 1. In yet other embodiments, the sample is accelerated by any mechanism capable of accelerating the sample to speeds high enough to cause disintegration of the sample upon impact with the collision surface 130 of FIG. 1.

Next, at step 230, the sample collides with the collision surface 130 of FIG. 1.

Next, at step 240, the collision of the sample 120 of FIG. 1 with the collision surface 130 of FIG. 1 disintegrates the sample 120 of FIG. 1 into gaseous molecular species, including individual molecular neutral species 150 of FIG. 1 (e.g., gaseous molecular neutrals), and molecular ionic species 140 of FIG. 1 (e.g., gaseous molecular ions).

In some embodiments, the disintegration is due solely to mechanical forces and the release of kinetic energy. In other embodiments, the disintegration due to mechanical forces is augmented, or further facilitated, by elevating the temperature of the collision surface 130 of FIG. 1. In some embodiments, the collision surface 130 can kept at subambient temperatures. In other embodiments, the collision surface 130 can be kept at ambient or superambient temperatures (e.g., up to 1000° C. or higher). In some embodiments, the sample inlet 110 can be kept at subambient temperatures. In other embodiments, the sample inlet 110 can be kept at ambient or superambient temperature (e.g., up to 1000° C. or higher). In some embodiments, a temperature difference is applied between the collision surface 130 and the other elements of the system for surface impact ionization 100 (e.g., sample inlet 110, or other surfaces). In some of these embodiments in which a temperature difference is applied, the collision surface 130 is at a higher temperature than the other elements of the system for surface impact ionization 100 (e.g., sample inlet 110 or other surfaces). In other embodiments in which a temperature difference is applied, the collision surface 130 is at a lower temperature than the other elements of the system for surface impact ionization 100. In some embodiments, the ratio of positive and negative ions produced upon impact is shifted by applying an electrical potential difference between the collision surface 130 of FIG. 1 and the ion optics of the mass spectrometer. Placing a positive electrical potential on the collision surface 130 relative to the first element of the ion optics can enhance the formation of positive ions and suppress the formation of negative ions while placing a negative electrical potential on the collision surface 130 relative to the first element of the ion optics can enhance the formation of negative ions and suppress the formation of positive ions. As mentioned above, the application of electrostatic potential between the collision surface 130 and the ion optics can have the additional advantageous effect of minimizing the neutralization of already-existing ionic components of the sample 120.

Next, at step 250, the ions produced during the collision event are collected for transportation to the ion analyzer unit while the neutrals and other waste particles produced during the collision event can be discarded.

Next, at step 260, the collected ions are transported to the ion analyzer unit to be read/analyzed by the mass spectrometer.

Figure 3:
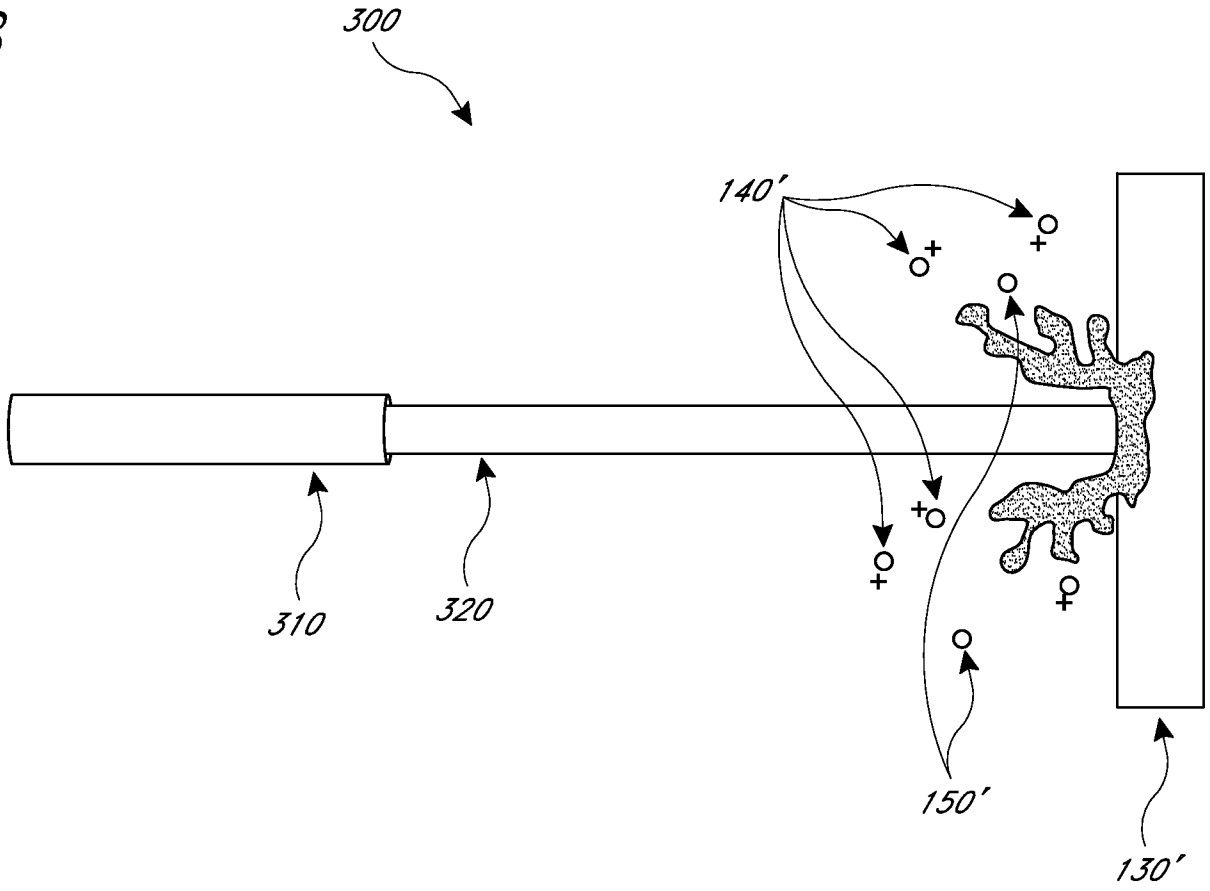
FIG. 3 is a schematic view of another embodiment of a system for converting a liquid phase sample into gaseous ions.

FIG. 3 illustrates another embodiment of a system for surface impact ionization 300. The system 300 includes a liquid sample nozzle or inlet 310, a liquid sample beam (liquid jet) 320, a collision surface 130', at least one molecular ionic species 140', and at least one molecule or other neutrals 150'.

The sample inlet 110', sample beam 120' collision surface 130', molecular ionic species 140', and molecular neutral species 150' as illustrated in this and other figures can be similar (e.g., identical) to components and elements discussed elsewhere and having the same reference number.

In operation, the system 300 operates in a nearly identical manner to the system 100 of FIG. 1. The liquid jet 320 is introduced through the liquid sample nozzle 310 from a high pressure regime to the lower pressure regime of a mass spectrometer device. Particles of the liquid jet 320 are accelerated by the pressure differential of the high pressure regime to low pressure regime. After acceleration, the accelerated liquid jet 320 impacts onto the collision surface 130' which disintegrates the continuous liquid jet 320 into individual molecular neutral species 150', and molecular ionic species 140'. The impact driven disintegration is purely mechanical, driven by the kinetic energy of the particles in the liquid jet 320 and produces both positive and negative ions. Both the positive and negative ionic species formed on the impact event between the liquid sample beam 320 and collision surface 130' are collected and transferred into the ion optics of the ion analyzer unit.

In some embodiments, the mechanical force based disintegration of the liquid jet 320 can be augmented, or further facilitated, by elevating the temperature of the collision surface 130'. In some embodiments, the temperature of the collision surface 130' is elevated via contact heating, resistive heating, or radiative heating. In some embodiments, the collision surface 130' can kept at subambient temperatures. In other embodiments, the collision surface 130' can be kept at ambient or superambient temperatures (e.g., up to 1000° C. or higher). In some embodiments, the liquid sample nozzle 310 can be kept at subambient temperatures. In other embodiments, the liquid sample nozzle 310 can be kept at ambient or superambient temperature (e.g., up to 1000° C. or higher). In some embodiments, a temperature difference is applied between the collision surface 130' and the other elements of the system for surface impact ionization 300 (e.g., liquid sample nozzle 310, or other surfaces). In some of these embodiments in which a temperature difference is applied, the collision surface 130' is at a higher temperature than the other elements of the system for surface impact ionization 300 (e.g., liquid sample nozzle 310 or other surfaces). In other embodiments in which a temperature difference is applied, the collision surface 130' is at a lower temperature than the other elements of the system for surface impact ionization 300.

In some embodiments, the ratio of positive and negative ions produced upon impact is shifted by applying a potential difference between the collision surface 130' and the ion optics of the mass spectrometer as disclosed above. The application of electrostatic potential between the collision surface 130' and the ion optics can have additional the advantageous effect of minimizing the neutralization of already-existing ionic components of the liquid jet 320.

In some embodiments the collision surface 130' is placed in an ion funnel or ring electrode type ion guide that advantageously can increase collection and transmission efficiency of both the originally introduced ions and those formed on the impact event to substantially 100%.

Figure 4:
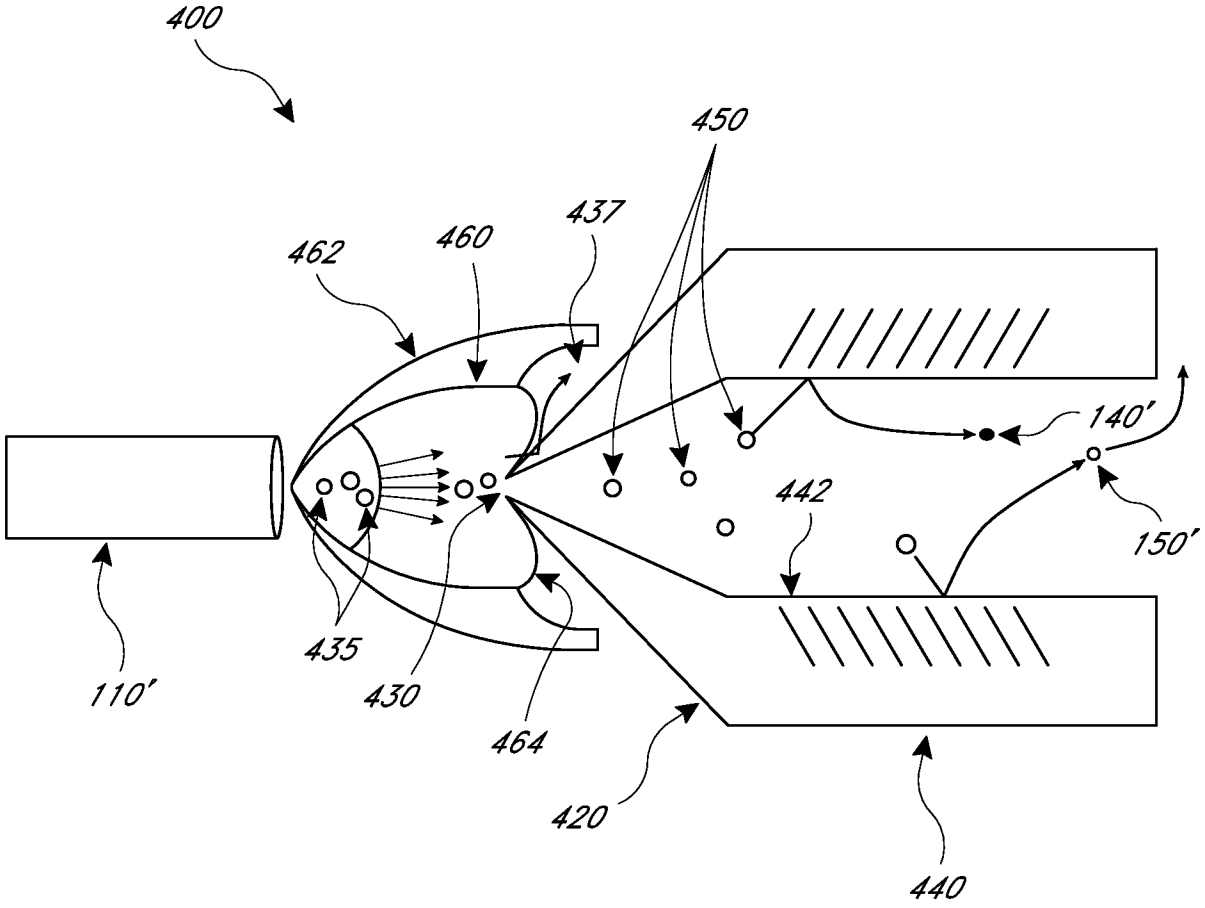
FIG. 4 is a schematic view of still another embodiment of a system for converting a liquid phase sample into gaseous ions.

FIG. 4 illustrates another embodiment of a system for surface impact ionization 400. The system 400 includes a sample inlet 110', a skimmer electrode 420, a skimmer electrode inlet/gap 430, a skimmer electrode tubular extension 440, sample particles 435, particles having a non-zero radial velocity component 450, molecular ionic species 140', molecular neutral species 150', and a sample particle velocity profile 460 (e.g., barrel shock and free jet expansion) with a jet boundary 462 and Mach disk 464.

In operation, the system 400 operates in a manner similar to that of the system 100 of FIG. 1. Sample particles 435 exit the sample inlet 110'. The sample particles 435 leaving the sample inlet 110' entering the vacuum regime of the mass spectrometer are accelerated above sonic speed in a free jet expansion. The skimmer electrode 420 skims off some of the sample particles 435 as discarded particles 437 allowing only some of the sample particles 435 to pass through the skimmer electrode inlet/gap 430. The sample particles 435 continue on into the remainder of the skimmer electrode 420. The remaining sample particles 435 pass through the skimmer electrode tubular extension 440, some of which become particles having a non-zero radial velocity component 450. The particles having a non-zero radial velocity component 450 impact into the inner cylindrical wall 442 of the skimmer electrode tubular extension 440. Upon collision with the inner cylindrical wall 442, certain molecular constituents are converted into molecular ionic species 140' (e.g., gaseous molecular ions), which continue through the skimmer electrode tubular extension 440 and into the mass spectrometer. The sample particle velocity profile illustrates one embodiment of the velocity profiles of particles as they leave the comparatively high pressure regime of the sample inlet 110' and enter the comparatively low pressure regime of the skimmer electrode 420 and ion analyzer accelerating in a free jet expansion. In some embodiments, the skimmer electrode inlet/gap 430 extends just into the Mach disc 464 as shown in FIG. 4.

Note that the embodiment variations applied in the system 100 of FIG. 1 are also applicable to the system 400.

Figure 5A:
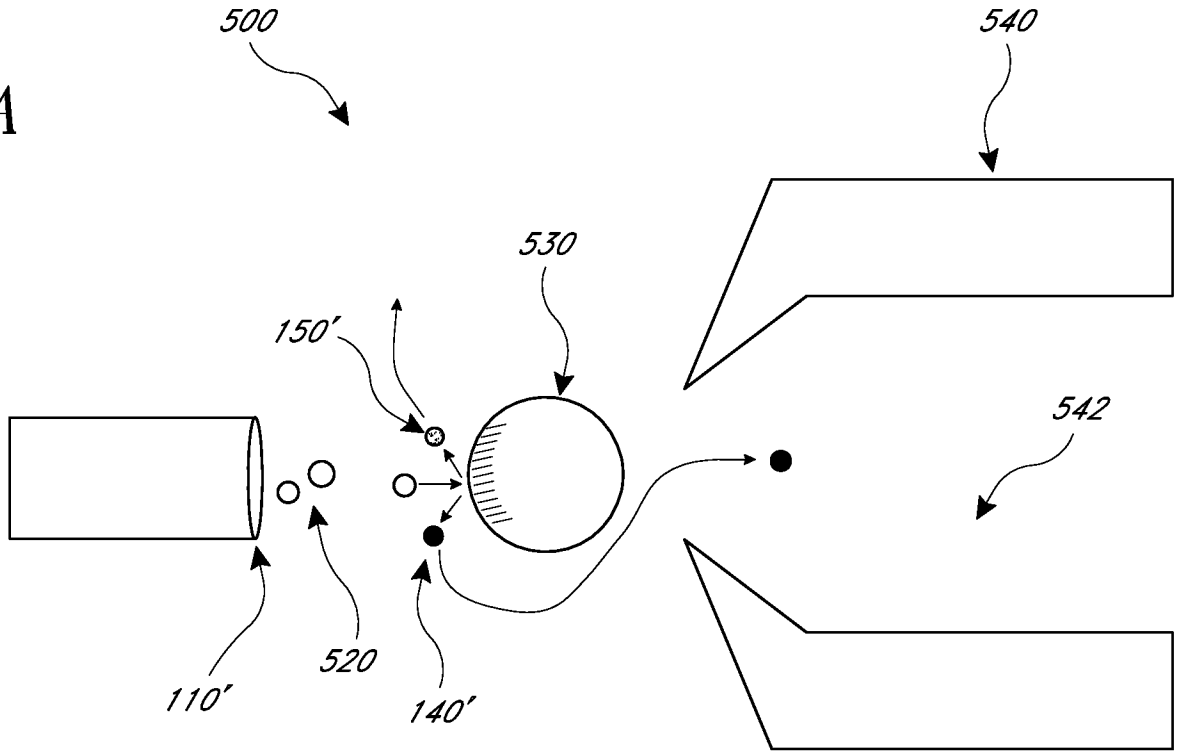
FIG. 5A is a schematic view of yet another embodiment of a system for converting a liquid phase sample into gaseous ions.

FIG. 5 illustrates another embodiment of a system for surface impact ionization 500. FIG. 5 A illustrates a schematic enlarged view of the system 500. FIG. 5 B illustrates a detailed schematic of the system 500. The system 500 includes a sample inlet 110', atmospheric gas carrying aerosol particles 520, a spherical collision surface 530, a skimmer electrode 540, and gaseous molecular species, including molecular ionic species 140' (e.g., gaseous molecular ions) and molecular neutral species 150'.

In operation, the sample inlet 110' (the inlet of the atmospheric interface of the mass spectrometer) is used to introduce atmospheric gas carrying aerosol particles 520 into the vacuum regime of the mass spectrometer. As discussed above, the sample particles are accelerated by the pressure differential between the atmospheric and vacuum regimes of the system 500. In further operation the beam of atmospheric gas carrying aerosol particles 520 impacts the spherical collision surface 530. Finally, the molecular ionic species 140' pass around the spherical collision surface 530 to enter the skimmer electrode 540 along the longitudinal axis of a lumen 542 of the skimmer electrode 540. The molecular neutral species 150' are generally skimmed off by the skimmer electrode 540 and therefore do not enter the mass spectrometer.

Figure 5B:
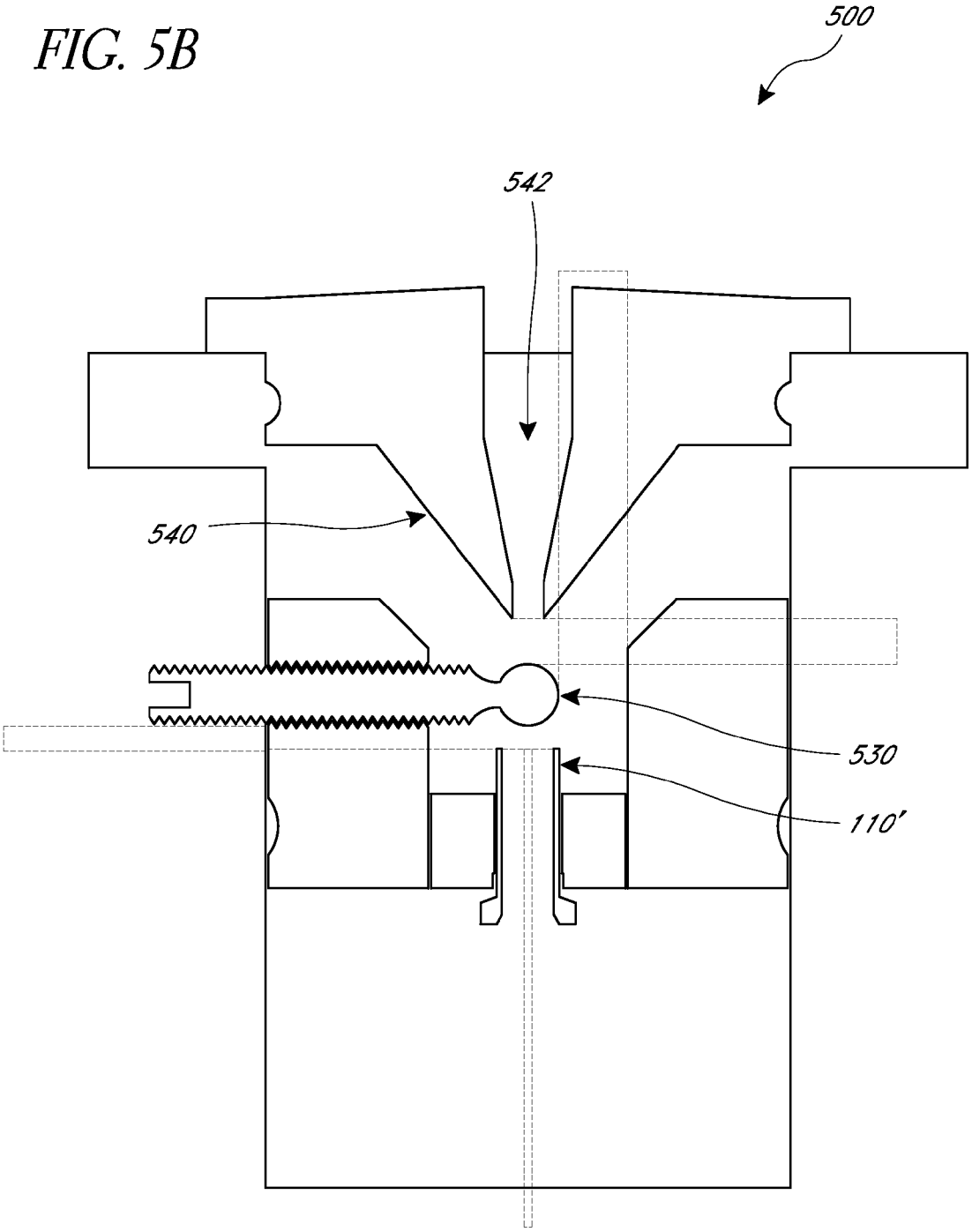
FIG. 5B is a detailed schematic view of the embodiment of a system for converting a liquid phase sample into gaseous ions of FIG. 5A.

In some embodiments, the spherical collision surface 530 is completely spherical. In other embodiments, the spherical collision surface 530 is partially spherical. In yet other embodiments, the spherical collision surface 530 is teardrop shaped with the rounded bottom of the teardrop facing the sample inlet 110' while the pointed top of the teardrop faces the skimmer electrode 540. In some embodiments, the spherical collision surface 530 is permanently fixed along the same axis as the axes of the sample inlet 110' and the lumen 542 of the skimmer electrode 540. In some embodiments, the spherical collision surface 530 can be offset from said axes to the requirements of a user. Accordingly, the spherical collision surface 530 can be generally aligned with (e.g., extend along the same or be offset from) the axes of the sample inlet 110' and lumen 542 of the skimmer electrode 540. Translation of the spherical collision surface 530 to an offset position can, in one embodiment, be effected as depicted in FIG. 5B by using a threaded spherical collision surface arm 550. In some embodiments, the internal diameter of the sample inlet 110' is in the range of about 0.1-4 mm, about 0.2-3 mm, about 0.3-2 mm, about 0.4-1 mm, and 0.5-0.8 mm, including about 0.7 mm. In some embodiments, the distance between the sample inlet 110' and the spherical collision surface 530 is in the range of about 1-10 mm, about 2-9 mm, about 3-8 mm, and about 4-7 mm, including about 5 mm. In some embodiments, the spherical collision surface 530 or skimmer electrode 540 intrudes just into the Mach-disc of the free jet expansion to advantageously improve performance. In some embodiments, the diameter of the spherical collision surface 530 and skimmer electrode 540 is in the range of about 0.5-5 mm, about 0.75-4 mm, and about 1-3 mm, including about 2 mm. In yet other embodiments, the distance between the spherical collision surface 530 and skimmer electrode 540 is in the range of about 1-20 mm, about 2-18 mm, about 3-16 mm, about 4-14 mm, about 5-12 mm, about 6-10 mm, and about 7-8 mm, including about 3 mm.

In some embodiments, the spherical collision surface 530 is made out of metal. In other embodiments, the spherical collision surface 530 is made out of any other conductive material. In some embodiments, the collision surface 530 can be heated in a manner similar to those described above in connection with other embodiments. In some embodiments, the surface of the spherical collision surface 530 is uncharged/neutral. In some embodiments, an electrical potential can be applied to the surface of the spherical collision surface 530 through electrical connectors or any other mechanism of applying an electrical potential to a surface. In embodiments in which an electrical potential is applied to the spherical collision surface 530, the potential facilitates passage of molecular ionic species 140' around the spherical collision surface 530 into the skimmer electrode 540 and along the central axis of the skimmer electrode 542 to be transported to the mass spectrometer. In some embodiments, the potential difference between the spherical collision surface 530 and the skimmer electrode 540 is about 10V, about 20V, about 30V, about 40V, about 50V, about 75V, about 100V, and about 1000V as well as values in between. Additionally, any other appropriate potential differences can be applied which are suitable for increasing ion concentrations.

Figure 6:
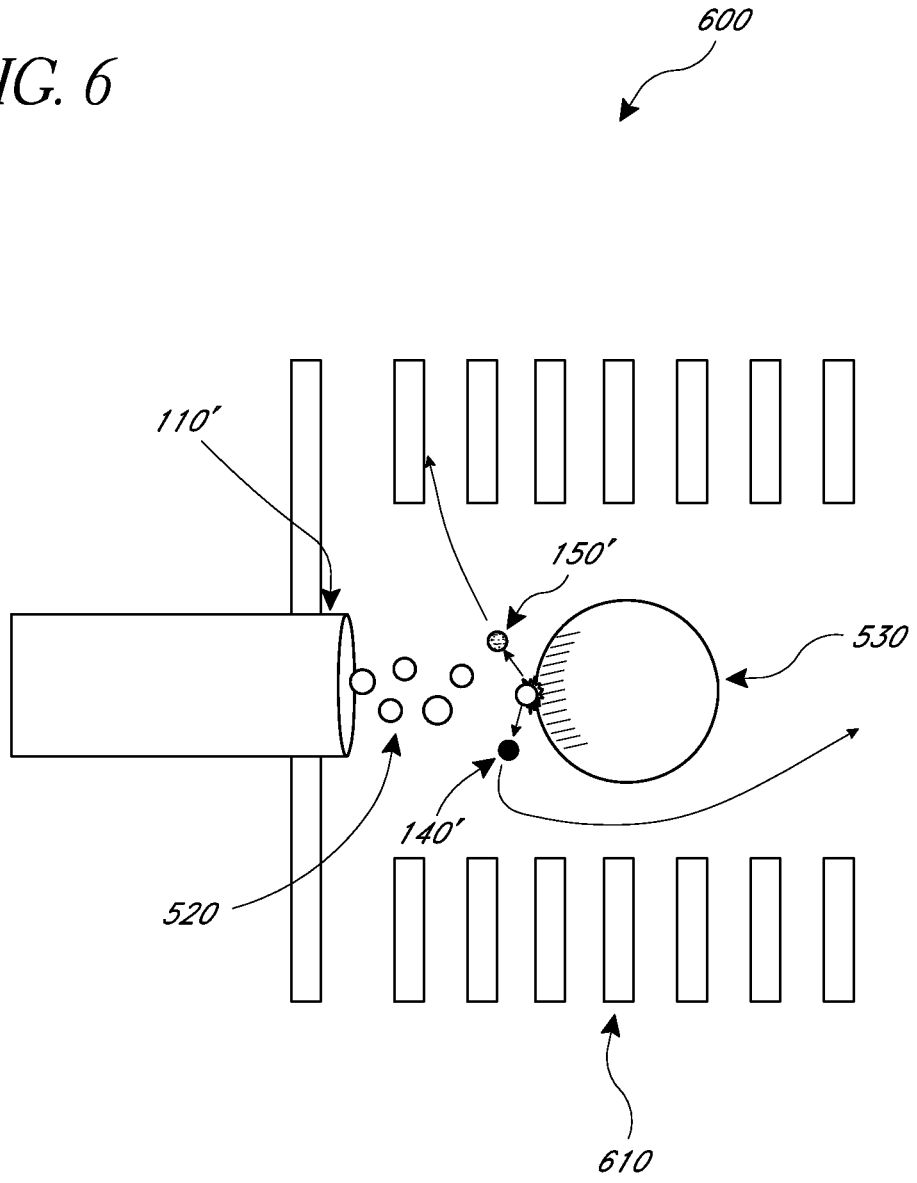
FIG. 6 is a schematic view of another embodiment of a system for converting a liquid phase sample into gaseous ions.

FIG. 6 illustrates another embodiment of a system for surface impact ionization 600. The system 600 includes a sample inlet 110', atmospheric gas carrying aerosol particles 520', a spherical collision surface 530', molecular ionic species 140', molecular neutral species 150', and a bipolar radiofrequency alternating current driven ion guide assembly 610.

In operation, the atmospheric gas carrying aerosol particles 520 enter the system 600 through the sample inlet 110' from a high pressure regime to the lower pressure regime of the mass spectrometer device. The atmospheric gas carrying aerosol particles 520 are accelerated by the pressure differential of the high pressure regime to the low pressure regime.

After acceleration, the accelerated atmospheric gas carrying aerosol particles 520 impact onto the spherical collision surface 530' and disintegrate. The disintegration creates gaseous molecular species, including molecular ionic species 140' (e.g., gaseous molecular ions) and molecular neutral species 150', inside of the bipolar radiofrequency alternating current driven ion guide assembly 610. The molecular ionic species 140' generated by the collision instigated disintegration are kept inside the bipolar radiofrequency alternating current driven ion guide assembly 610 via the pseudopotential field generated by the radiofrequency alternating current potential. The molecular neutral species 150' are unaffected by the pseudopotential of the bipolar radiofrequency alternating current driven ion guide assembly 610 and can therefor freely leave the bipolar radiofrequency alternating current driven ion guide assembly 610 and be pumped out of the system 600 via an appropriate vacuum system.

Figure 7:
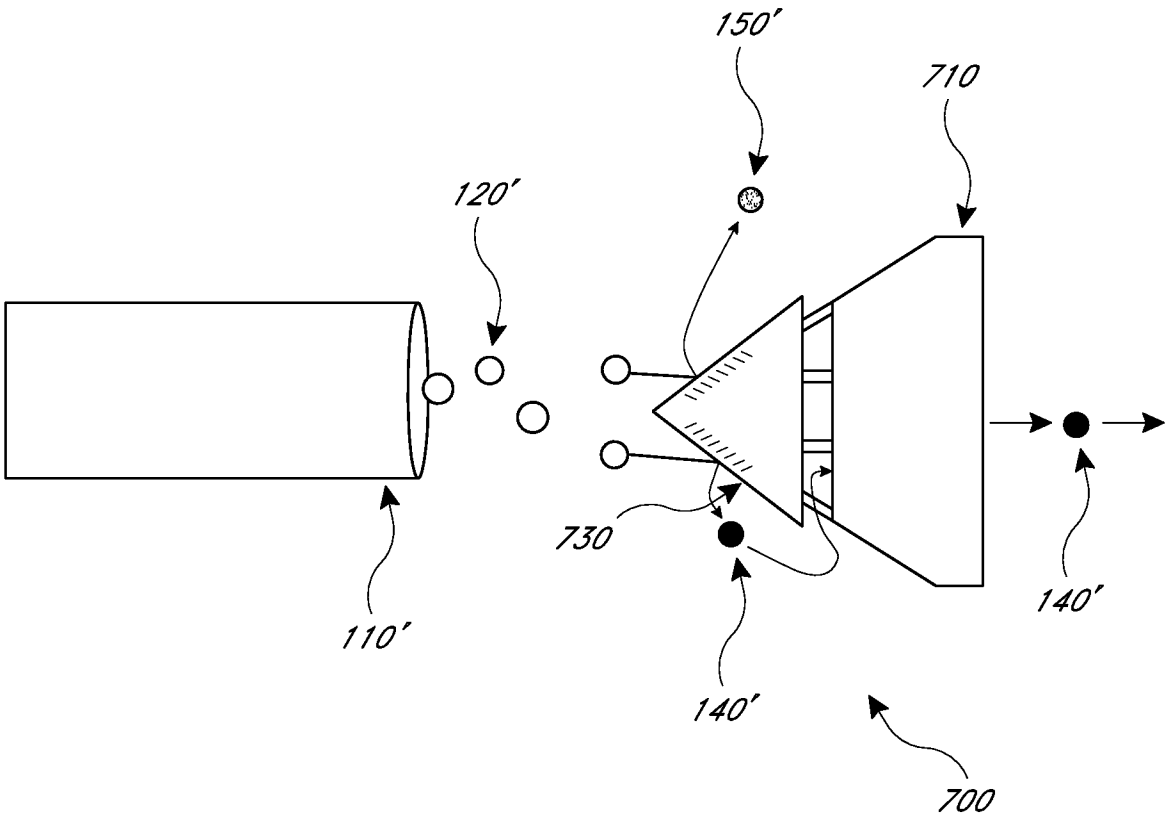
FIG. 7 is a schematic view of another embodiment of a system for converting a liquid phase sample into gaseous ions.

FIG. 7 illustrates another embodiment of a system for surface impact ionization 700. The system 700 is similar to the system 500 of FIG. 5. The system 700 includes a sample inlet 110', a sample 120' (e.g., a sample beam), a conical collision surface 730, a skimmer electrode 710, and gaseous molecular species, including molecular ionic species 140' (e.g., gaseous molecular ions) and molecular neutral species 150'.

The operation of the system 700 is similar to that of the system 500, except that a conical collision surface 730 is used instead of a spherical collision surface 530. Using a conical collision surface 730 instead of a spherical collision surface 530 can advantageously allow more efficient momentum separation of the ions formed on the impact disintegration events which is reflected in a higher degree of mass selectivity with regard to varying distances between the conical collision surface 730 and the skimmer electrode 710. In this case, heavier particles of the molecular ionic species 140' will have more momentum and will therefore be "skimmed off" the sample along with the molecular neutral species 150'. Hence, only less massive molecular ion species 140' will be transported to the ion analyzer unit of the mass spectrometer.

Figure 8A:
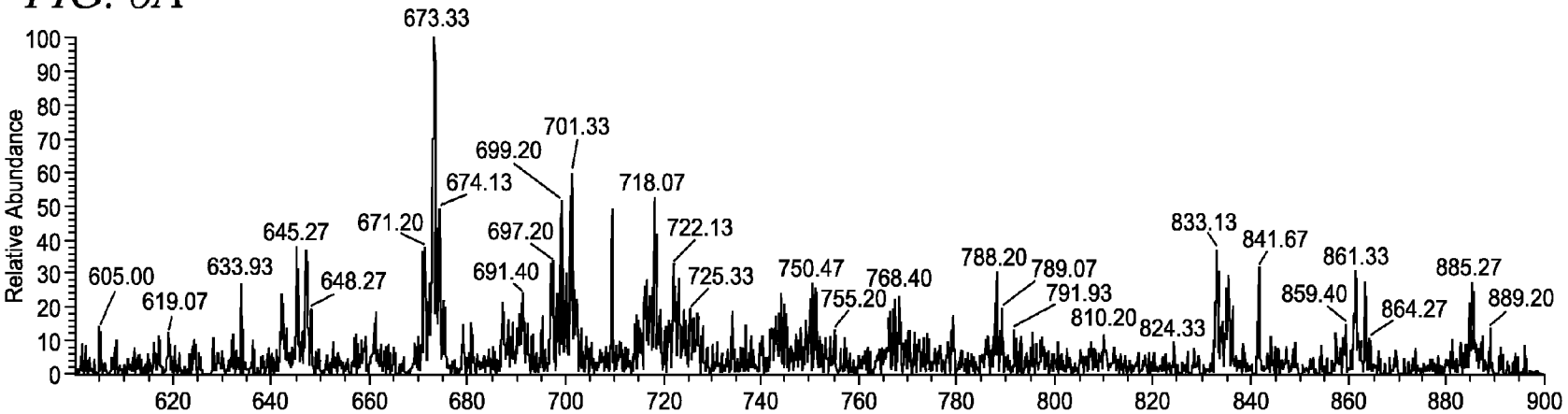
FIGS. 8A and 8B are graphs of spectra produced by variations on the embodiment of a system for converting a liquid phase sample into gaseous ions shown in FIGS. 5A and 5B.
Figure 8B:
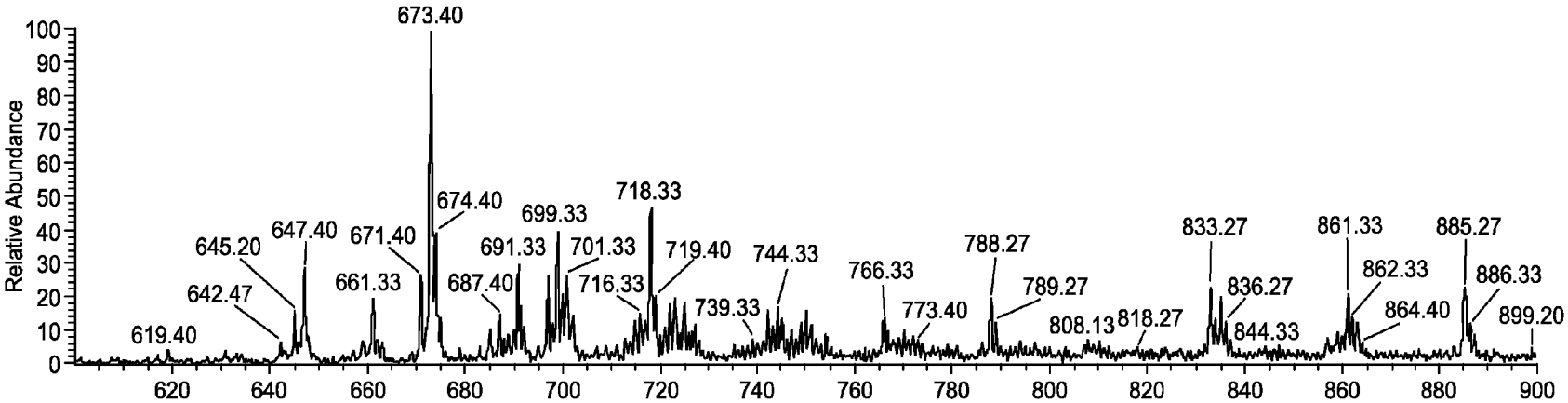

FIG. 8 illustrates spectra obtained by systems as disclosed herein. FIG. 8A illustrates a spectrum obtained by the system 500 when the spherical collision surface 530 is not present and therefore is not being used. FIG. 8B illustrates a spectrum obtained by the system 500 when the spherical collision surface 530 is present and therefore is being used. The signal to noise ratio observed in FIG. 8A is 8.726 while the signal to noise ratio observed in FIG. 8B is 12.574—a 144.1% improvement. This decrease in noise is associated with the momentum separation created by the flux formed around the sphere. Specifically, solid particles have significantly higher mass compared to single molecular ionic species 140', and therefore such solid particles are not capable of following the orbit having a short radius of curvature created on the surface of the sphere while the single molecular ionic species 140' are capable of following such a path. In other embodiments, flow around the collision surface can be turbulent, such that solid particles are not able to follow around the collision surface into a skimmer electrode, thereby being skimmed and discarded. Therefore, the solid particles leave the surface of the sphere at a different place compared to the lighter single molecular ionic species 140'. With proper adjustment/tuning, the molecular ionic species 140' will reach the skimmer electrode 540 opening while larger clusters follow a different trajectory and do not enter the skimmer electrode 540 opening and hence do not reach the ion analyzer unit of the mass spectrometer.

The formation of ions can be facilitated by applying electrostatic potential to the spherical collision surface 530, usually in identical polarity to the polarity of the ion of interest. In such a manner, the trajectory of the ions leaving the surface and the amount of ions passing through the opening of the skimmer can be regulated.

Figure 9A:
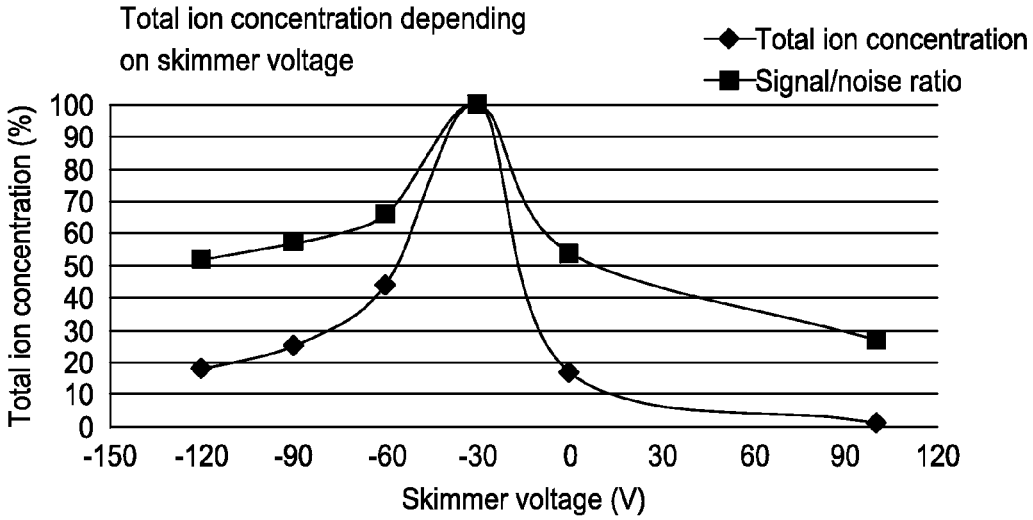
FIGS. 9A and 9B are graphs of total ion concentration and signal to noise ratio, respectively, for varying skimmer electrode and spherical collision surface voltages, produced by the embodiment of a system for converting a liquid phase sample into gaseous ions shown in FIGS. 5A and 5B.
Figure 9B:
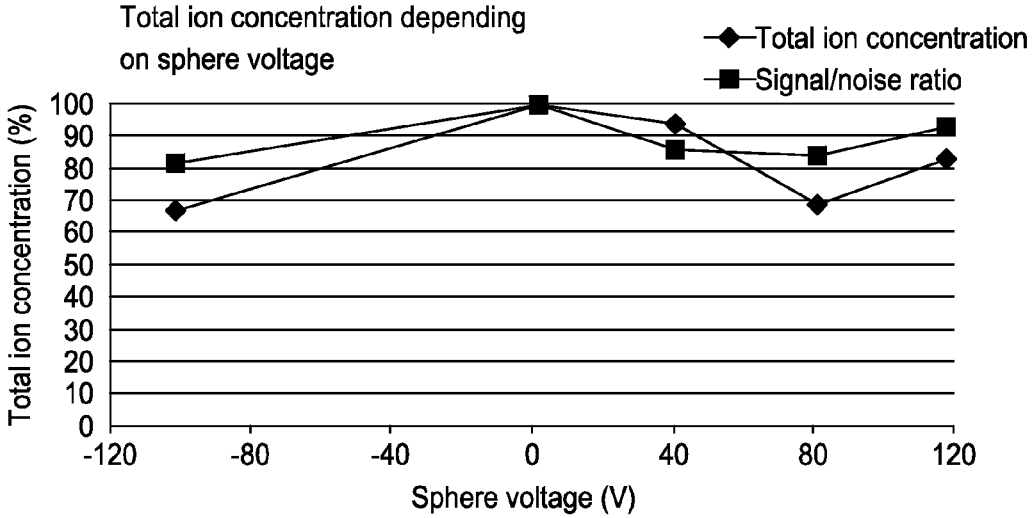

FIG. 9 illustrates the different total ion current as a function of the spherical collision surface 530 potential and the skimmer electrode 540 potential. FIG. 9A illustrates the total ion concentration and the signal to noise ratio versus the skimmer electrode 540 voltage. FIG. 9B illustrates the total ion concentration and the signal to noise ration versus the spherical collision surface 530 voltage. The skimmer electrode 540 potential has a significant influence on the total ion current. Conversely, changing only the spherical surface potential does not significantly alter the total ion current. As can be seen from the graphs in FIGS. 9A and 9B, the optimal setting was −30V for the skimmer electrode 540 voltage and +20V for the spherical collision surface 530 voltage—a 50V difference between the two voltages.

ILLUSTRATIVE EXAMPLES

Example 1

Ionization of Surgical Aerosol

The system illustrated in FIG. 5 was used in this example. Surgical electrocautery was done using a handpiece containing a monopolar cutting electrode. The cutting blade was embedded in an open 3.175 mm diameter stainless steel tube which was connected to a flexible polytetrafluoroethylene (PTFE) tube 2 m long and 3.175 mm in diameter. The PTFE tube was used to transport the aerosol containing gaseous ions from the surgical site to the mass spectrometer by means of a Venturi gas jet pump. The Venturi pump was operated at a flow rate of 20 L/min. The pump exhaust was placed orthogonally to the atmospheric inlet of the mass spectrometer.

Porcine hepatic tissue was sampled using the electrocautery system as just described. The surgical smoke was lead into the modified atmospheric interface of an LCQ Advantage Plus (Thermo Finnigan, San Jose, Calif.) mass spectrometer and the spectra produced analyzed.

The sample does not contain few if any ions when it reaches the atmospheric interface. Therefore, it is hard or impossible to analyze it with any conventional atmospheric interface. In the vacuum space of the first part of the interface, ions were generated with the collision method herein disclosed. The ion formation took place on the surface of the spherical ion-generating component.

Ion-loss can be minimized through optimization of material, shape, size, and position variables for the spherical collision surface—in such a manner, even better signal to noise levels can be achieved using the techniques and systems disclosed herein.

The surface impact ionization systems 100, 300, 400, 500, 600 and 700 disclosed herein have several advantages over currently available systems which render its use highly advantageous in many scenarios. Initially, the systems disclosed are simple and highly robust for the ionization of molecular components of both liquid phase samples and aerosols. Additionally, the systems provide for a dramatically enhanced efficiency of ionization methods, producing large quantities of charged and neutral molecular clusters. Lastly, the systems disclosed herein are uniquely adapted to discard unwanted neutral molecular clusters resulting in the benefits of decreased instrument contamination and concomitantly lowered maintenance demands, significantly lower levels of detector noise and improved signal to noise ratios.

Of course, the foregoing description is of certain features, aspects and advantages of the present invention, to which various changes and modifications can be made without departing from the spirit and scope of the present invention. Thus, for example, those skill in the art will recognize that the invention can be embodied or carried out in a manner that achieves or optimizes one advantage or a group of advantages as taught herein without necessarily achieving other objects or advantages as can be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or sub-combinations of the specific features and aspects between and among the different embodiments can be made and still fall within the scope of the invention. Accordingly, it should be understood that various features and aspects of the disclosed embodiments can be combined with or substituted for one another in order to form varying modes of the discussed devices, systems and methods (e.g., by excluding features or steps from certain embodiments, or adding features or steps from one embodiment of a system or method to another embodiment of a system or method).

What is claimed is:

1. A method for generating gaseous molecular ions for analysis by a mass spectrometer or ion mobility spectrometer, comprising:

accelerating an aerosol sample toward a solid surface, the sample comprising one or more of molecular particle clusters, solid particles, and neutral particles;

colliding the aerosol sample with the solid surface to disintegrate the one or more molecular particle clusters and to generate one or more of gaseous molecular ions, neutral molecules and smaller-sized molecular particle clusters; and collecting the gaseous molecular ions and directing the gaseous molecular ions to an analyzer unit.

2. The method of claim 1, further comprising analyzing the gaseous molecular ions to provide information on the chemical composition of the sample.

3. The method of claim 1, wherein collecting comprises collecting the gaseous molecular ions with a skimmer electrode generally aligned with an opening through which the sample is introduced.

4. The method of claim 1, wherein accelerating the sample comprises driving the sample via a pressure gradient along a tubular opening through which the sample is introduced.

5. The method of claim 4, wherein accelerating the sample further comprises establishing an electrical potential gradient between the tubular opening and the solid surface.

6. The method of claim 5, wherein one of a positive electrical and a negative electrical potential is applied to the solid surface.

7. The method of claim 1, wherein accelerating the sample comprises accelerating the sample above sonic speed in a free jet expansion.

8. The method of claim 1, wherein collecting the gaseous molecular ions comprises separating the gaseous molecular ions from the neutral molecules and smaller-sized molecular particle clusters.

9. The method of claim 8, wherein separating comprises generating turbulence along at least a portion of the collision element, said turbulence allowing the gaseous molecular ions to separate from the neutral molecules and smaller-sized molecular particle clusters.

10. The method of claim 1, further comprising heating the solid surface via one of contact heating, resistive heating and radiative heating.

11. The method of claim 1, wherein the solid surface is a generally spherical surface.

12. The method of claim 11, wherein said solid surface is disposed in an ion funnel type mass spectrometric atmospheric interface, said ion funnel configured to collect the gaseous molecular ions.

13. The method of claim 11, wherein said solid surface is disposed between an opening through which the sample is introduced and a skimmer electrode.

14. The method of claim 1, wherein the solid surface is a generally conical surface.

15. The method of claim 1, wherein the solid surface is a generally tubular surface of a skimmer electrode.

16. The method of claim 1, wherein the disintegration of the one or more molecular particle clusters is purely mechanical, driven by the kinetic energy of the particles in the sample.

17. The method of claim 1, further comprising separating the neutral molecules and smaller-sized molecular particle clusters from the gaseous molecular ions based on mass using a skimmer electrode that allows collection and direction of substantially only the gaseous molecular ions.

18. The method of claim 1, further comprising separating an ion of interest from the gaseous molecular ions based on one or more of mass and charge using a skimmer electrode that allows collection and direction of substantially only the ion of interest to the analyzer unit.

19. A system for generating gaseous molecular ions for analysis by a mass spectrometer or ion mobility spectrometer, comprising:

a tubular conduit configured to accelerate a sample therethrough, the sample comprising one of an aerosol sample and a liquid sample and having one or more of molecular particle clusters, solid particles and charged particles;

a collision element spaced apart from an opening of the tubular conduit and generally aligned with an axis of the tubular conduit, the collision element having a surface upon which the sample collides, thereby disintegrating the one or more molecular particle clusters to form one or more of gaseous molecular ions, neutral molecules and smaller-sized molecular particle clusters; and a skimmer electrode configured to collect substantially only the gaseous molecular ions and exclude the neutral molecules and smaller-sized molecular particle clusters, wherein the exclusion is based substantially on one or more of mass and charge of the neutral molecules and smaller-sized molecular particle clusters, the skimmer electrode having an opening generally aligned with the tubular conduit opening such that the collision element is interposed between the tubular conduit opening and the skimmer electrode.

20. The system of claim 19, further comprising an analyzer configured to analyze the gaseous molecular ions collected by the skimmer electrode to provide information on the chemical composition of the sample.

21. The system of claim 19, wherein the tubular conduit is configured to direct a substantially continuous liquid jet onto the surface of the collision element.

22. The system of claim 19, further comprising a vacuum source configured to generate a vacuum between the tubular conduit and the collision element to create a pressure gradient along the tubular conduit that causes the sample to accelerate onto the surface of the collision element.

23. The system of claim 22, further comprising a power source configured to establish an electrical potential gradient between the tubular conduit opening and the surface of the collision element, said electrical potential gradient further accelerating the sample onto the surface of the collision element.

24. The method of claim 23, wherein one of a positive electrical and a negative electrical potential is applied to the collision element.

25. The system of claim 22, wherein the sample is accelerated above sonic speed in a free jet expansion.

26. The system of claim 19, wherein one or more of the collision element and the skimmer electrode is configured to separate the gaseous molecular ions from the neutral molecules and smaller-sized molecular particle clusters.

27. The system of claim 26, wherein turbulence along at least a portion of the collision element surface facilitates the separation of the gaseous molecular ions from the neutral molecules and smaller-sized molecular particle clusters.

28. The system of claim 19, further comprising a heating source chosen from the group consisting of a contact heating source, a resistive heating source and a radiative heating source, the heating source configured to heat the collision element surface.

29. The system of claim 19, wherein the collision element surface is a generally spherical surface.

30. The system of claim 19, wherein the collision element surface is a generally conical surface.

31. The method of claim 19, wherein the disintegration of the one or more molecular particle clusters is purely mechanical, driven by the kinetic energy of the particles in the sample.

32. The method of claim 19, wherein the tubular conduit is configured to cause the sample to undergo free jet expansion.

33. A system for generating gaseous molecular ions for analysis by a mass spectrometer or ion mobility spectrometer, comprising:

a tubular conduit configured to accelerate an aerosol sample therethrough, the sample having one or more of molecular particle clusters, solid particles and neutral particles;

a collision element spaced apart from an opening of the tubular conduit and generally aligned with an axis of the tubular conduit, the collision element having a generally spherical surface upon which the sample collides, thereby disintegrating the one or more molecular particle clusters to form one or more of gaseous molecular ions, neutral molecules and smaller-sized molecular particle clusters; and an ion funnel guide assembly generally aligned with said tubular conduit opening and driven by a bipolar radiofrequency alternating current, said collision element disposed in said ion funnel, wherein the ion funnel guide assembly is configured to separate the gaseous molecular ions from the neutral molecules and smaller sized molecular particle clusters, and to direct the gaseous molecular ions to an analyzer.

34. The system of claim 33, further comprising an analyzer configured to analyze the gaseous molecular ions collected by the ion funnel type mass spectrometric atmospheric interface to provide information on the chemical composition of the sample.

35. The method of claim 33, wherein the disintegration of the one or more molecular particle clusters is purely mechanical, driven by the kinetic energy of the particles in the sample.

36. A system for generating gaseous molecular ions for analysis by a mass spectrometer or ion mobility spectrometer, comprising:

a tubular conduit configured to accelerate a sample therethrough, the sample comprising one of an aerosol sample and a liquid sample and having one or more of molecular particle clusters, solid particles and charged particles;

a skimmer electrode spaced apart and generally aligned with an opening of the tubular conduit, the skimmer electrode having a tubular section with a surface upon which sample particles collide to generate gaseous molecular ions; and an analyzer unit that receives said gaseous molecular ions from the skimmer electrode, the analyzer unit configured to analyze the gaseous molecular ions to provide information on the chemical composition of the sample.

37. The system of claim 36, further comprising a vacuum source configured to generate a vacuum between the tubular conduit and the skimmer electrode to create a pressure gradient along the tubular conduit that causes the sample to accelerate onto said surface.

38. The system of claim 36, wherein the sample is accelerated above sonic speed in a free jet expansion.

* * * * *